United States Patent [19]

Kammerer et al.

[11] Patent Number: 4,936,517

[45] Date of Patent: Jun. 26, 1990

[54] DOCUMENT SHREDDER

[75] Inventors: Martin Kammerer, Balingen; Richard Huber, Balingen-Frommern, both of Fed. Rep. of Germany

[73] Assignee: Ideal-Werk Krug & Priester GmbH & Co. KG, Balingen, Fed. Rep. of Germany

[21] Appl. No.: 260,233

[22] Filed: Oct. 20, 1988

[30] Foreign Application Priority Data

Oct. 20, 1987 [DE] Fed. Rep. of Germany ..... 3735396

[51] Int. Cl.[5] ..... B02C 18/24

[52] U.S. Cl. ..... 241/101.2; 241/236

[58] Field of Search ..... 241/36, 236, 101.2, 241/101.1, 100, 223

[56] References Cited

U.S. PATENT DOCUMENTS 4,627,577 12/1986 Hyuga et al. ..... 241/223 X

FOREIGN PATENT DOCUMENTS 3619126 8/1987 Fed. Rep. of Germany ... 241/101.2

*Primary Examiner*—Mark Rosenbaum

*Attorney, Agent, or Firm*—Toren, McGeady & Associates

[57] ABSTRACT

The invention is directed to a document shredder (1) driven by an electric motor (2), with a stepdown gear train (4, 5, 7, 8) arranged between the drive and the cutting mechanism (9). Hitherto these appliances were powered by AC motors, which operate already relatively slow cutting speed when shredding low quantities of paper sheet layers, and in which the breakdown torque occurs at a very early stage. Prejudices existed up to now against the use of DC motors in document shredders because of a number of reasons. In the invention a DC motor (2) especially a series-wound motor is now used as a drive for a document shredder (1). It has the decisive advantage, of enabling a high cutting speed with small quantities of paper layers, which decreases approximately continuously as a function of the quantity of paper layers, wherein stoppage is to be expected only with very high quantities of paper layers.

5 Claims, 2 Drawing Sheets

DOCUMENT SHREDDER

The invention is directed to a document shredder powered by an electric motor with stepdown gearing interposed between the drive and the cutting mechanism. Appliances of this type are required on the one hand to comminute the paper to be destroyed as rapidly as possible and on the other hand to process as many paper layers as possible simultaneously, without the machine stopping operation because of overload. The known machines are powered by AC or three-phase current motors, which do not fulfill these requirements. The cutting speed achievable with these motors is relatively low with the usual sizes and drops slightly as a function of the quantity of the number of layers of paper to be processed. The breakdown torque is however attained already with comparatively few layers of paper. Therefore, one is forced to preprocess the material to be destroyed in order to adapt the quantity of layers of paper to the output of the motors.

It is indeed known that DC motors have another torque characteristic, however such motors have up to now not been used in document shredders, since there existed considerable prejudice against their installation. The rpm of such motors lies namely in the neighborhood of 10,000 revolutions per minute compared to 1400 with AC motors of comparable power. Therefore one tended to the view that a document shredder could not be adapted to such high rpms. Furthermore, one was concerned that the commutators would be excessively contaminated by the paper dust and would wear and that the motors could not withstand continuous loads. Apart from that DC motors operating at high rpms cannot be reversed frequently, since the commutator can be destroyed by the spark gap. DC motors have also the disadvantage that they can only tolerate short periods of stoppage when under load and because of this appear to be unsuitable for the operation of document shredders. All these considerations were instrumental in the trade not utilizing DC motors in document shredders up to now.

The present invention overcomes these prejudices and uses a DC motor for driving a document shredder. The concerns involving continuous operation are seen to be invalid, since interruptions always arise also with document shredders when supplying and removing the material. In the course of these the motor always reverts to its idling rpm, which is considerably higher than with AC motors and therefore assures an excellent ventilation, especially since with the low current flow in this condition there occurs only minimum heating. Reversing of a document shredder and the motor powering same occurs mostly at very large loads and in that case the rpm is already in the region which is harmless for the commutator or the carbon brushes. In addition the DC motor has still other essential advantages, namely the easy electronic rpm control, a higher starting torque as well as being essentially independent of the line voltage. Of particular essence is however the increased operating speed with a low number of layers of paper compared to an AC motor, which diminishes approximately uniformly at increased supplies of material to be comminuted, wherein the stoppage of the motor occurs considerably later than is the case with an AC motor. The current draw capacity corresponds for the rest of it in this type of motor essentially to the power requirement, so that overall also the efficiency is improved. Furthermore, such a DC motor is considerably lighter and less expensive, which simplifies the overall design.

Because of the already mentioned high rpm of such a motor the stepdown ratio of the gear train is adapted to the motor according to another feature of the invention and is designed to be correspondingly greater than in an AC motor. Preferably the gear train comprises an additional stepdown stage. In order to decrease the noise generation resulting from the high rpm and the greater stepdown ratio, and the shock because of the flywheel mass, the additional stepdown stage is designed as a belt drive. Furthermore the DC motor is resiliently supported in order to decrease the noise transmitted by the structure and is provided with a covering preventing the entry of dust as well as absorbing the noise transmitted by the air. The motor is provided with a current limiting device according to an additional feature of the invention in order to avoid damage to the motor during stoppage while under load.

The drawing shows an embodiment example of the invention.

Figure 1:
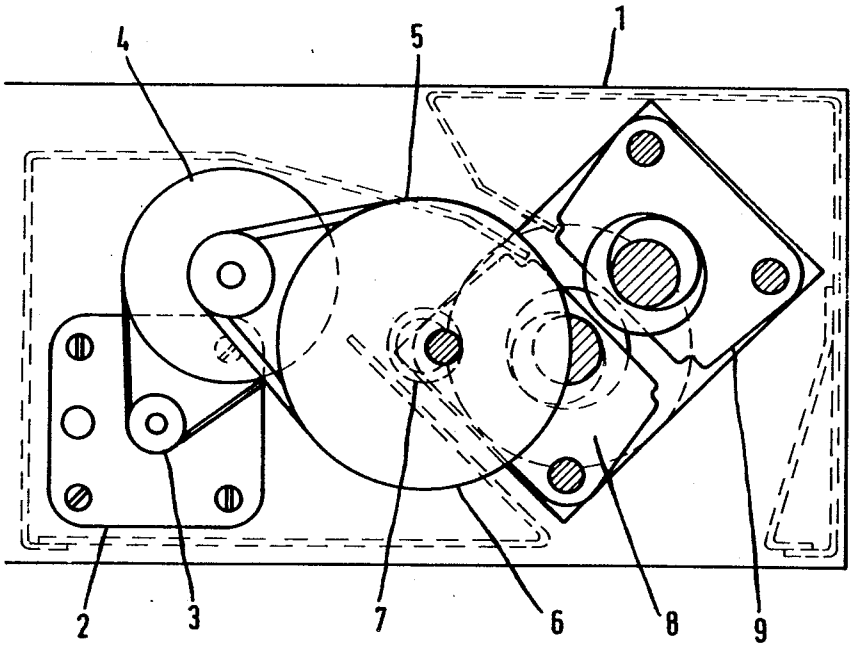
FIG. 1 is a diagrammatic section through a document shredder.

A DC motor 2 is resiliently supported in the housing 1 in a manner not depicted in detail. A stepdown belt drive 4 is connected with the motor shaft 3, which stepdown drive is followed by a second stepdown belt drive 5. Its belt disk 6 is connected with a pinion 7, which drives the gear wheel 8 of the cutting mechanism 9 also with a stepdown ratio.

Figure 2:
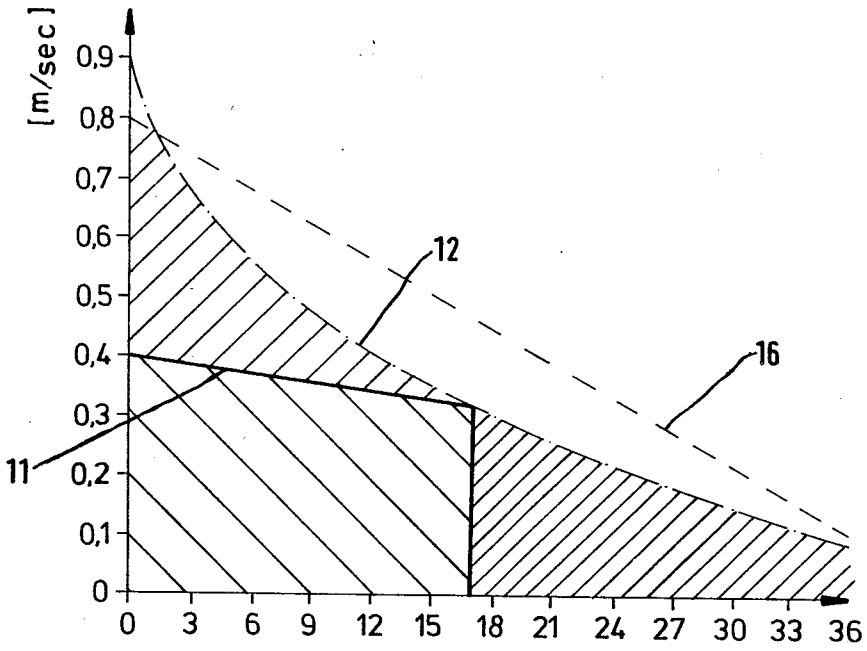
FIG. 2 is a characteristic curve diagram of a document shredder.

As has already been explained previously, constant speed independent of the paper layer thickness would in principle be desired. This target can only be achieved by oversized motors in an uneconomical manner, so that it already constitutes a considerable advantage compared to the state of the art, if the speed decreases proportionally with the increasing quantity of sheets of paper, as can be recognized in the curve 10 in FIG. 2 shown in broken lines. The characteristic curve of the known AC motor is designated with 11 and demonstrates that the speed decreases here also with the thickness of the paper layers, however the breakdown torque occurs at a very early date. The curve 12 of the series-wound DC motor shows a close approximation to the ideal curve 10, wherein on the one hand a considerably greater speed is achieved with thin layers of paper than is the case with the AC motor and on the other hand the stoppage occurs considerably later than with said AC motor. Thus one achieves an approximately ideal characteristic curve with a document shredder equipped with such a DC motor.

We claim:

1. A document shredder, comprising:

cutting means;

electric motor drive means including a DC current motor (2); and step-down gear train means arranged between the cutting means and the drive means so that the electric motor drive means changes speed and torque automatically depending upon document volume, the gear train means including a first step-down stage and an additional step-down stage, the additional step-down stage being a belt drive.

2. A document shredder as defined in claim 1, wherein the DC motor is a series wound motor.

3. A document shredder as defined in claim 1, wherein the DC motor is resiliently supported, and further comprising a protective cover arranged so as to cover the DC motor, to protect it from dust, and to absorb noise.

4. A document shredder as defined in claim 1, wherein the motor drive means includes a current limiting device provided for the DC motor.

5. A document shredder as defined in claim 1, and further comprising electronic control means for controlling the DC motor.

* * * * *